United States Patent [19]

Deucher

[11] 4,076,304

[45] Feb. 28, 1978

[54] ERECTING SEAT STRUCTURE TO ASSIST INVALIDS FROM SEATED TO STANDING, UPRIGHT POSITION, PARTICULARLY ERECTING WHEELCHAIRS

[75] Inventor: Conrad Deucher, Uster, Switzerland

[73] Assignee: Valutec AG, Uster, Switzerland

[21] Appl. No.: 762,204

[22] Filed: Jan. 24, 1977

[30] Foreign Application Priority Data

Jan. 30, 1976 Switzerland ..... 1184/76

[51] Int. Cl.[2] ..... A61G 5/00

[52] U.S. Cl. ..... 297/45; 297/330; 297/DIG. 10; 297/437

[58] Field of Search ..... 297/DIG. 10, 42, 44, 297/45, 330

[56] References Cited

U.S. PATENT DOCUMENTS

| | | | |
|---|---|---|---|
| 909,411 | 1/1909 | Hockney | 297/45 |
| 2,053,852 | 9/1936 | Tracy | 297/330 X |
| 2,927,631 | 3/1960 | Andersson | 297/42 X |
| 3,343,871 | 9/1967 | Yates | 297/330 X |
| 3,379,450 | 4/1968 | Jones | 297/330 X |
| 3,406,772 | 10/1968 | Ahrent | 297/DIG. 10 |
| 3,414,324 | 12/1968 | Taylor | 297/330 X |
| 3,589,769 | 6/1971 | Bressler | 297/42 |
| 3,804,460 | 4/1974 | Leffler | 297/330 |
| 3,851,917 | 12/1974 | Horstmann | 297/DIG. 10 |

*Primary Examiner*—Francis K. Zugel
*Attorney, Agent, or Firm*—Flynn & Frishauf

[57] ABSTRACT

To provide for smooth simple operation of an erecting seat, a motor, through a reduction gearing, drives a shaft located transverse of the seat structure, or wheelchair, to the end points of which a crank drive is attached coupled to the seat, the crank drive being arranged to provide, upon erecting or lowering movement of the seat a nonlinear time-displacement function which is effectively sinusoidal, so that movement of the seat between the end positions starts slowly, then is accelerated, and then again slowly reaches the end position. Erecting movement can be assisted by springs, preferably located at either side of the seat.

17 Claims, 6 Drawing Figures

Figure 2:
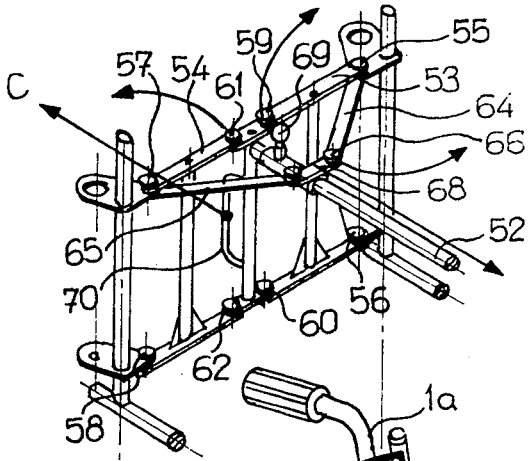

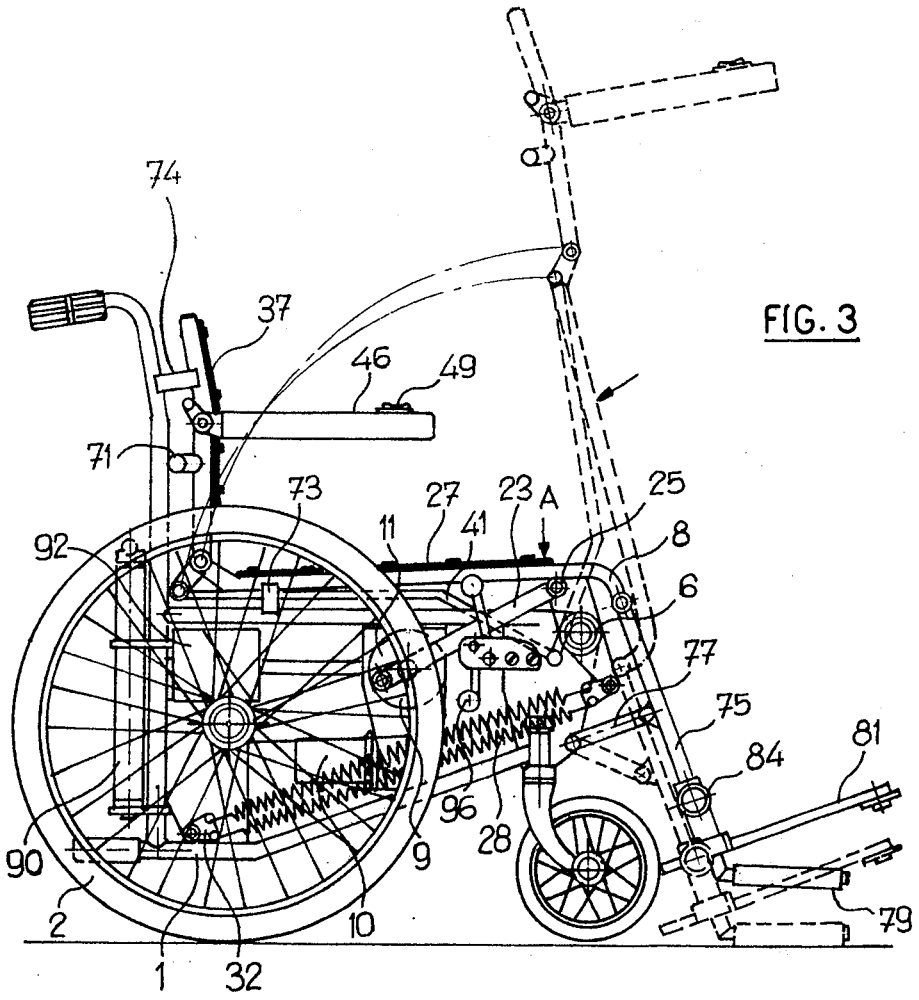
FIG. 3
FIG. 4
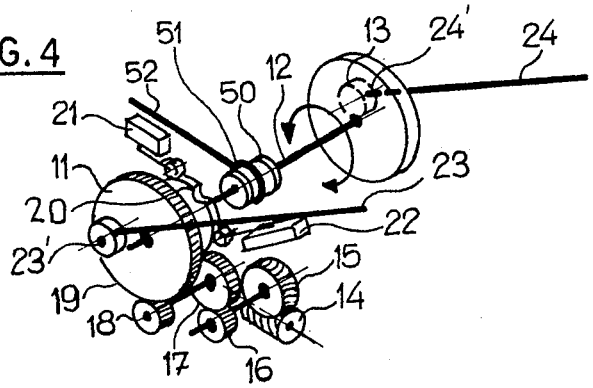

ERECTING SEAT STRUCTURE TO ASSIST INVALIDS FROM SEATED TO STANDING, UPRIGHT POSITION, PARTICULARLY ERECTING WHEELCHAIRS

The present invention relates to an erecting seat structure particularly to assist invalids from seated to standing, upright position, and more particularly to an erecting-type wheelchair which, preferably, is constructed to be collapsible.

Various erecting-type seat structures have been proposed which are used to change the position of an invalid from seating to at least approximately vertical, upright standing position. Such structures are particularly used for patients who had strokes, or the like. The advantages of such erecting-type seat structures for the patient are well known. Repeated movement, from seated to upright position and return, increases the blood supply and stimulates the blood circulatory system. The possibility to effect upright standing and walking exercises without external assistance or special apparatus is of particular medical importance. Decubital ulcers, bedsores, osteoporosis, and other results of extended unchanging position can be decreased. Additionally, and very importantly, the patient can feel that he is independent of external help and thus in control of his own movement; the increased movability permits increased integration into professional life and in the community. The selfassurance provided by the independence which the patient obtains in himself being able to rise from seated position is of substantial psychological importance, particularly since it permits the patient to be at the same eye level as a standing partner in a conversation.

Erecting seat structures of the type to which the present invention relates have previously been proposed — see, for example, U.S. Pat. No. 3,589,769. This structure illustrates a seat and a back support, both of which include a plurality of upholstered rollers. Relative movement between the user and the engaging supporting surfaces result upon the erecting movement, or upon the change from erecting to seating position of the seat structure, and the rollers decrease friction in order to facilitate the sliding motion between the body of the user and the respective components of the structure. Using rollers for the feet and the back support facilitates change-over from seated to erected position, but has the disadvantage that, if the user is in a seated position for an extended period of time, the rollers are uncomfortable. The structure, further, is space-consuming and cannot be folded for transport or upon nonuse, so that a minimum of space is occupied thereby when not in actual use by a patient. Change-over from seated to erected position, particularly, is possible only with substantial effort on the part of the user. Frequently, the user, particularly if an invalid, therefore requires the assistance of nursing, or similar, personnel so that the psychological advantage of independence from outside help is not attained.

It is an object of the present invention to provide an erecting seat structure, and particularly such a structure adapted for mobile use, that is, for incorporation with a wheelchair, in which the disadvantages of the prior art are avoided, or at least substantially decreased.

Subject matter of the present invention: Briefly, a motor drive is provided which changes over the seat and back between two end or limiting positions, one being a seated and the other an erected position; the motor drive is coupled, preferably through reduction gearing, to a drive shaft which, at both sides of the user, is supplied with a crank arrangement. The crank arrangement is coupled to the seat and pivots the seat about a seat pivot axis. The crank drive results in a sinusoidal time-displacement function, upon uniform speed of the drive, which results in low speed at the end positions and high speed at the intermediate position. This particular relationship between speed and displacement of the seat is comfortable for the user, since abrupt starting and stopping is prevented.

In accordance with the feature of the invention, springs are provided which are so coupled to the seat that the generated torque is roughly proportional and counter to the torque applied to the seat resulting from the weight of the user. The spring force is so compensated by the weight of the user that the motor to effect the additional drive can be comparatively small. This also decreases the energy requirement of the motor so that supply batteries can readily be located on the frame of the structure. Upon erecting movement, the springs assist the change to upright position; upon seating movement, the springs brake the downward movement of the user.

Figure 1:
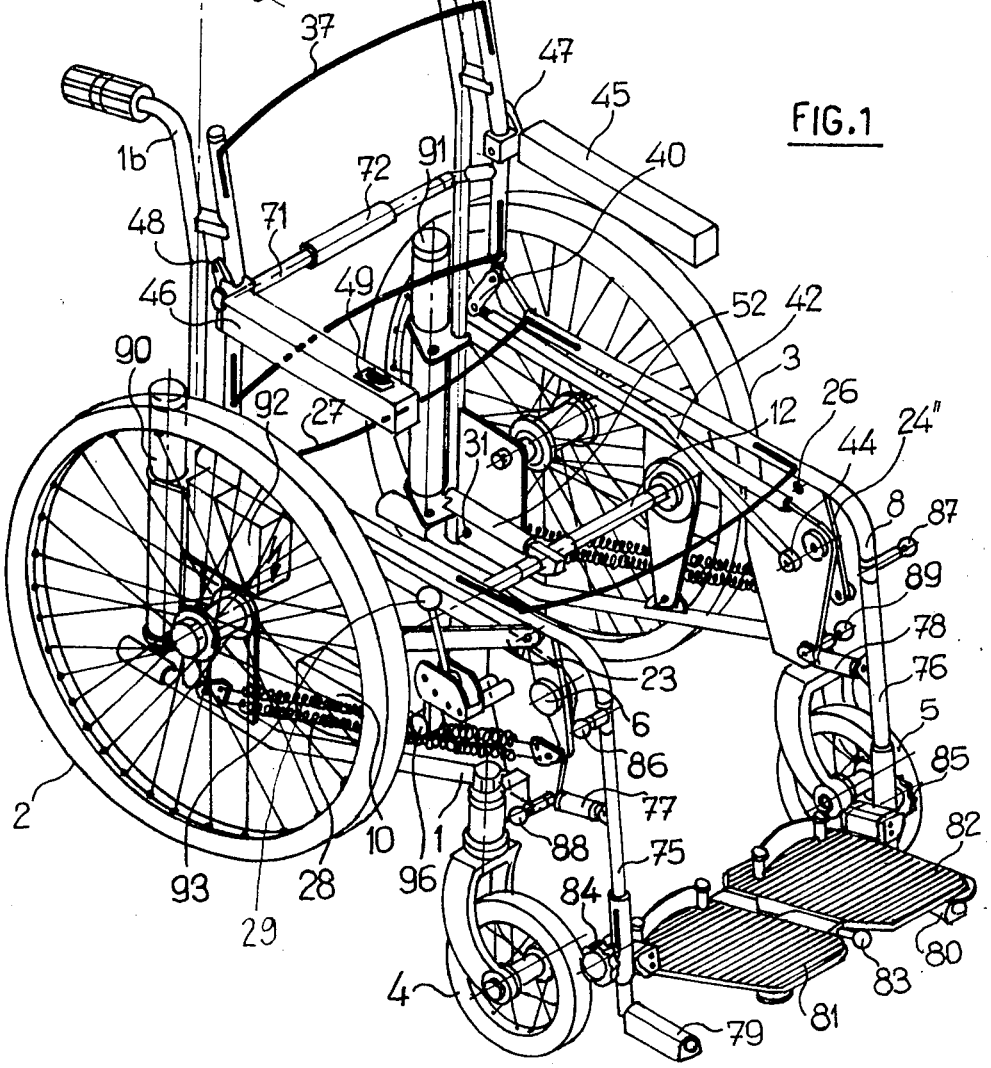
Figure 5:
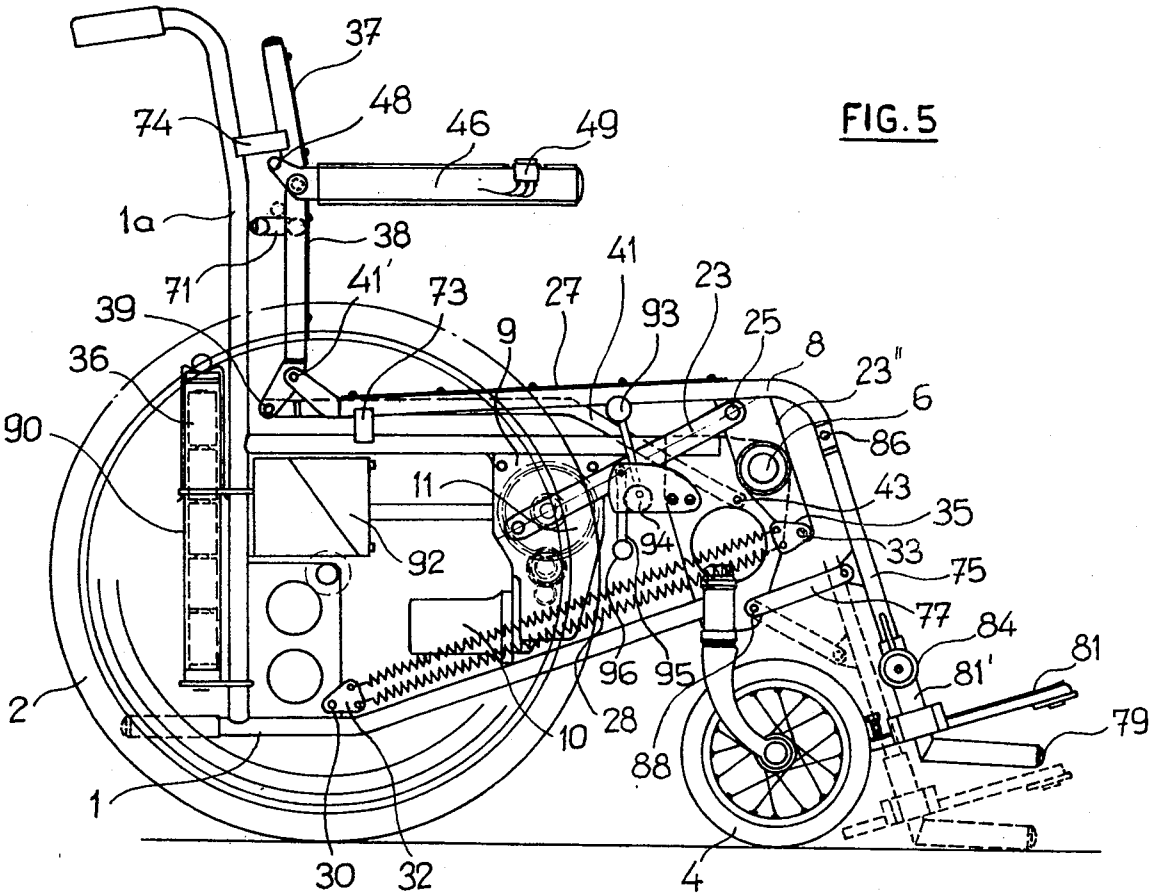
Figure 6:
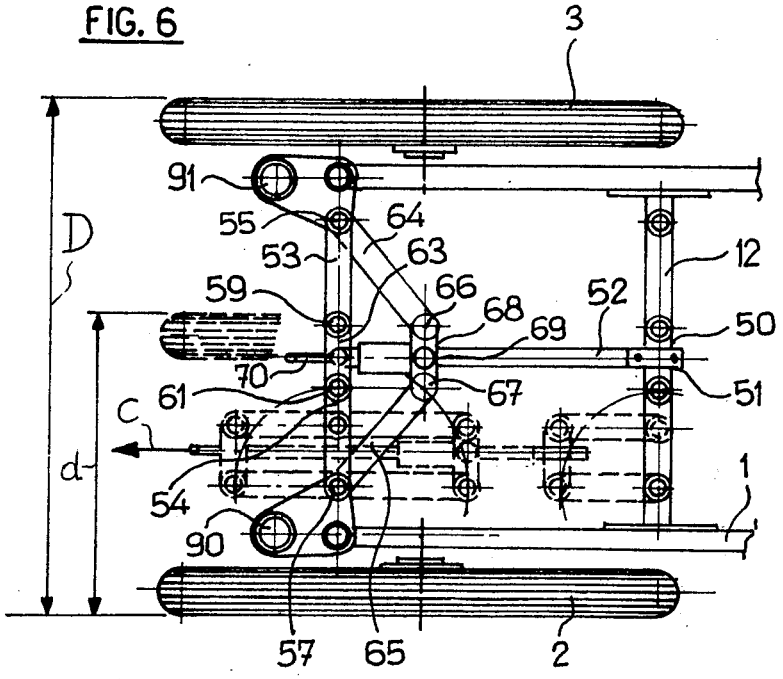

Accompanying drawings: an example of the inventive concept is illustrated in:

FIG. 1 showing a perspective view of the structure applied to a wheelchair, with the collapsing mechanism removed;

FIG. 2 a perspective view of the collapsing mechanism, and drawn in alignment with FIG. 1 to illustrate the relative positioning of the collapsing mechanism in the structure of FIG. 1;

FIG. 3 showing a side view of the structure, and the upper limiting position of the seat and back in broken lines, the chain-dotted lines showing direction of movement of the pivot points of the back;

FIG. 4 showing, schematically, the drive arrangement and gear train for the crank;

FIG. 5 showing a side view of the structure with one wheel removed, and the other wheel only schematically indicated; and FIG. 6 showing a top view of the wheelchair in open and folded position.

The frame 1 is formed of two lateral or side frames 1*a*, 1*b*, made of welded tubular stock. In a preferred form, and particularly when the structure is to be made as a wheelchair, main wheels 2 and 3 and guide wheels 4, 5, are provided, suitably connected to the frame. At either side of the frame 1, pivots 6, 7, are secured in which a seat erection frame 8 is pivoted. Seat 27 is secured to the erection frame 8. The mechanism to erect and lower seat 27 comprises a motor 10 and a gear ring 9. Gear ring 9 (FIG. 5) is seen in detail in FIG. 4. The gear ring 9 drives a pair of crank discs 11, 13, which are coupled by a drive shaft 2. Preferably, either side of the seat or frame 1 is supplied with a crank disc 11, 13, to provide for synchronous operation of both discs.

The gear ring 9 (FIGS. 3, 5) as best seen in FIG. 4 includes a worm 14 coupled to the output shaft of the motor 10. Worm 14 engages a worm gear 15 and intermediate gears 16, 17, 18 to provide a substantial reduction to final drive gear 19 which may be formed, for example as in FIG. 4, at the circumference of disc 11. The disc 11 additionally is coupled to a cam 20 which is engaged by cam followers coupled to switches 21, 22 functioning as limit switches and connected by suitable wiring (not shown) to motor 10 to disconnect the motor 10 when the seat has reached either one of its limiting or end positions.

The discs 11, 13 together with crank rods 23, 24 each form a crank drive, or crank arrangement. The rods 23, 24 are pivoted by pivot pins 23', 24' to the drive discs 11, 13 and excentrically positioned. Each one of the rods 23, 24 is secured to support carriers 23", 24" which are attached to the seat erecting frame 8. Bolts 25, 26 connect the respective rods 23, 24 to the plates or carrier 23", 24".

The seat itself is shown in FIG. 1 in heavier lines; the seat 27, as drawn out schematically only in FIG. 1, is supported between the rods 8. The seat, preferably, is a leather, or fabric panel stretched between frame members 8. If the structure need not be collapsible, then the seat may be made as a solid construction; it is a specific advantage of the structure in accordance with the present invention, however, that the erecting-type wheelchair can be folded.

Seat 27 can be brought into either extreme position, and in any intermediate position there between. The two extreme positions are determined by the positions of the switches 21, 22 with respect to the cam disc 20. Preferably, micro switches are used for the switches, as best seen in FIG. 4.

The mechanism to erect and lower the seat is formed by the crank drive consisting of the drive discs 11, 13, and the crank rods 23, 24. The pivot points 23', 24' are so located on the respective discs 11, 13 that, initially, upon movement from a limiting position toward the other limiting position, the movement starts slowly, accelerates to a maximum, and again slows. The relationship, or transfer function between time and distance of movement, assuming essentially uniform speed of the motor 10 transmitted through the gear ring 9 to the crank discs 11, 13, then will be essentially sinusoidal, that is, in accordance with a sine wave. This sinusoidal acceleration and deceleration of movement is of particular advantage for patients having a walking disability, since the initial movement of the seat to upright position is slow, and without abrupt jolts or jars and, likewise, ends slowly and smoothly. Yet, the erecting movement proceeds with suitable speed, since the continued movement to intermediate positions is accelerated.

The weight of the user is balanced by two pairs of tension springs; each pair has two springs 28, 29, one pair each being located at the respective sides of the seat. The springs 28, 29 are secured by bolts 30, 31 to the frame 1 with one of their ends, and by tension discs 35 and bolts 33, 34 to the respective support plate 23", 24", secured to the seat. The springs are so arranged and have such strength that, when the seat is in its seated, or lower position, springs 28, 29 are biased to compensate approximately half of the weight of the patient, that is, the strength of the springs unload the seat due to the patients's weight by about half of his weight. The springs are pivoted to the frame, and to the respective carrier plate 23", 24" in such a manner that they counteract the loading placed on the seat by the patient. This arrangement is so made that in any position of the seat, the springs generate a torque which is proportional and counter the torque acting on the seat due to the weight of the user. Upon erection of the seat in the upper position, the springs are essentially unloaded, except for a minor initial bias to maintain their position. The springs thus form compensating springs which permit reduction of the power derived from the motor by about half. This substantially decreases the size of the motor and thus a motor 10 having comparatively low power can be used. The motor 10 is energized by battery 36. Using compensating springs permits use of nickle-cadmium batteries, so that the wheelchair can be used for a substantial period of time before recharging is needed. Two or more parallel springs are preferably provided, so that a standard wheelchair can be made and the weights of various users can be matched by adding, or removing springs, as needed, the number of springs being used being determined by the approximate weight of the user. Thus, one standard wheelchair can be used both for heavier men, light women and even for children, without any reconstruction, by the mere addition or removal of springs, substantially simplifying manufacture and stocking of replacement parts.

The backrest 37 retains its essentially vertical position regardless of the height or position of the seat, and its attitude is independent of the angular postion of the seat 27. To maintain this vertical position, it is connected by a linkage, or leverage arrangement to the seat structure by using a pair of parallelogram links 41, 42 (FIGS. 1 and 5) which are pivoted by pins 43, 44, respectively, to the seat frame 8. The parallelogram rods 41, 42 maintain the upright position of the backrest 37 in practically any position of the backrest with respect to the frame. The backrest is, additionally, coupled to the frame 8 of the seat to complete the parallelogram.

A pair of armrests 45, 46 are secured to the backrest structure 37. The armrests can be flipped upwardly. The limiting positions of the armrests are determined by abutment bolts 47, 48. One of the armrests, as shown armrest 46 also includes the operating switch 49 which is connected by suitable wiring to the motor 10 and to the battery.

In accordance with a feature of the invention, the lateral frame portions of the wheelchair are connected together by means of a scissor, or similar collapsable linkage. To permit collapse, the drive shaft 12, likewise, is formed with an intermediate joint. The end portions of the drive shaft, as well as the center thereof are articulated. As best seen in FIG. 4, a central bearing 51 is located centrally of the shaft 12, the bearing 51 being coupled to a rod 52, so that the portion 50 of the drive shaft 12 is separately journalled. A collapsable linkage in form of a lever system is secured to the seat 8 or to the frame 1 at the backside thereof. The linkage system includes two scissors members 53, 54 (FIG. 2) which are linked to the frame 1 by bolts 55, 56, 57, 58, and are further linked to a central portion 63 by bolts 59, 60, 61, 62. The central portion 63 is connected to the aforementioned rod 52. Two links 64, 65 are pivotally supported by bolts 55, 57 on the frame and are held on a locking member 68 by means of bolts 66, 67, to permit pivoting with respect thereto. The locking element 68 is longitudinally slidably secured to the rod 52 and can be locked by means of a lock pin 69 on rod 52. To collapse the wheelchair from the position shown in FIG. 1, and in solid lines in FIG. 6 to the broken-line position of FIG. 6, it is only necessary to release the lock 69 and pull on lever 70 in the direction of the arrow C (FIG. 2) which permits pivoting of the scissor links 53, 54. This, simultaneously, collapses the drive shaft 12 by engagement with the rod 52 (see FIGS. 2 and 4). The links 64, 65 insure that the wheelchair will collapse such that the two frame members **1*a*, 1*b* will be parallel. The open position is shown, schematically, in FIG. 6** by the longer dimension arrow D; the width of the collapsed position is shown by the shorter dimension arrow *d*.

The frame of the backrest 38 includes a linked stiffening element 71 which is coupled to a locking sleeve 72. The locking sleeve 72 is axially moved along lengths of the articulated link 71 to permit link 71 to fold, so that the backrest stiffening element 71 will be folded upon folding of the remainder of the structure.

The rods 8 of the seat are supported on the support 73 of the frame 1 when the wheelchair is in erected position. The backrest 37 is supported on the support 74 of the frame 1.

In accordance with a feature of the invention, a footrest is provided which moves upon erecting movement, in order to support the user on solid ground when the frame moves from seated to erected position. The footrest supports 75, 76 are secured, at the front side, by spring loaded bolts 86, 87. They are further attached by link lever 77, 78 to the frame 1. The footrest supports 75, 76 are formed with a floor support in the form of rubber blocks 79, 80 located at the underside, or bottom side. In normal position, that is, when the wheelchair is used as a seat, the rubber blocks 79, 80 are spaced from the support surface by about 8cm. This permits moving the wheelchair also over uneven surfaces and to clear small obstructions. When the wheelchair is changed from seated to erected position, the foot supports 75, 76, in accordance with the feature of the invention, are moved downwardly, thereby providing high stability of the chair and insuring its position with respect to a particular ground location. The footrests themselves are formed with footrest panels 81, 82 which are centrally connected by a locking lever 83. A guide sleeve 81' (FIG. 5) permits height adjustment, by engaging a set screw 84, 85 or the like to place the footrest panels in a desired level on the tubular footrest supports 75, 76. The footrest supports are complete replaceable separate units and can be removed from the wheelchair by disengaging spring loaded locking bolds forming catches 86, 87, 88, 89.

Power drive for the erecting movement of the chair is provided by batteries 36 located at both lateral sides of the wheelchair in battery holders 90, 91. The battery holders are preferably placed, as shown, at the rear of the wheelchair and arranged to accept tubular or rod-like batteries, thus permitting easy maintenance, charging, or replacement. There is sufficient space on the wheelchair to permit other appliances to be secured thereto. As shown, a battery charger 92 is secured to the frame. The wheelchair can be used as a stationary element, as well as a mobile unit. In the example shown, the motor can be supplied, as desired, from the batteries with battery current, or the wheelchair can be plugged in to a power outlet to supply the battery with rectified current, derived, respectively, directly from the network or through the battery charging unit.

For safety and ease of use, handbrakes are provided permitting simple blocking of the wheelchair. The brakes use a handlever 93 which is connected by eccenter 94, which acts on the brake lever 95 which, in turn, purports a brake block 96 which acts directly against the outer circumference of the wheels, typically against the outer surface of rubber tires 2.

Various change in modifications may be made; the embodiment of the invention has been described in connection with a wheelchair. The structure of the erecting seat may be used, however, without wheels as well and as a stationary unit. The function of elements of the erection mechanism can then be used alone, and possibly without the footrest. Various additional simplifications are possible, if the collapsing feature (FIG. 6) of the wheelchair is not needed, since the structure maintaining the lateral frames 1*a* and 1*b* apart then can be constructed as a stiff unit and the main draft shaft 12 can be a solid element.

The provision of multiple parallel springs 28, 29 is particularly appropriate when the wheelchair is collapsible. The springs are preferably of similar spring force and construction, so that matching of the wheelchair to the weight of the user is simple. Forming the frame to be partly collapsible permits easy and space consuming storage by changing the lateral width of the wheelchair from the small dimension *d* to the wide, open dimension D, when it is to be used. The drive shaft 12, when moved into extended position (FIG. 1) then, additionally, acts as a stiffening element.

Collapse of the wheelchair, as described, is simple. A simple operation permits simultaneous collapse of the scissor linkage and the main drive shaft. The connection links and elements can include further stiffening elements as well as the scissor links, as described. The scissor arrangement is preferred and insures uniform, parallel collapse of the wheelchair.

The various pivot points and link points are so arranged that the pivots between the seat and the foot support and/or the back support results in practically no relative movement between the body of the user and the seat and/or the back support. This arrangement has been selected to prevent relative movement between the seating surface and the body of the user during changing of the wheelchair from seated to erected position. The pivot points between seat and foot support on the one hand, and between seat and back support on the other are specifically positioned with respect to the location of the knee joint and the hip joint of the user. This permits solid seating and back support surfaces, for example, in the form of fabric or leather panels, if lateral collapse (FIG. 6) is desired, or solid upholstered seats if lateral collapse is not necessary. The seat, preferably, is recessed behind the front edge of the seating frame and is linked to the frame 1 at a position below the top part of the seating frame 8. This position of the pivot point with respect to the frame, as well as with respect to the seat support frame practically completely avoids any possibility of slipping of the patient, or user with respect to the seat.

The backrest is linked to the seat somewhat above the seating surface. This placement of the pivot point of the backrest with the seating surface frame places the pivot point roughly at the level of the hip joint of the user. In contrast to previously used erecting seats, slippage of the body of the user with respect to the backrest can thereby be effectively avoided.

The foot supports are preferably removable from the seat as a whole. If not needed, they can be easily removed. The provision of blocks 79, 80 insures positive placement of the wheelchair on a support surface when the wheelchair is to be erected and effectively prevents tipping of the wheelchair when it is placed in erected position (see broken line position FIG. 3). This arrangement of the link points and pivots permits solid positioning and therefore avoids the necessity of insuring stability due to weight of the chair alone; it is thus possible to make the erecting wheelchair of light weight material, substantially decreasing its weight over similar structures of the prior art without incurring the danger that the erecting wheelchair is tippy when upright. Nevertheless, the particular positioning of the link, or pivot points from the actual seating surface, as shown, insures that, when the wheelchair is in seating position, the footrest is lifted off the floor support with a sufficient remaining distance to clear small obstacles. Placement of the footrest panels in adjustable position permits use of the wheelchair by persons of various heights. FIG. 1 illustrates the use of two separate panels for footrest, panels 81, 82 which are linked together but can be locked in adjacent position by means of locking bolt 83. The additional effectively stiff transverse position at the lower forward portion of the structure contributes to the overall stability of the wheelchair, when erected and in the position shown in FIG. 1.

The parallelogram-attachment of the backseat 37 to the seating frame, by means of an additional holding or parallelogram rod 41, 42 insures upright positioning of the backrest, regardless of the particular instaneous position of the seating surface with respect to the end positions, that is, seated or erect. Thus, the backrest continues to support the user during the erecting movement. The parrallelogram rod is preferably located beneath the seat, secured to the seating rod or frame or the main frame besides being attached to the backrest. By locating the parallelogram rods beneath the seat, any interference with the user's body during erecting movement is avoided and thus accidents are effectively prevented. A parallelogram linkage is a simple and inexpensive arrangement while effectively stabilizing the position of the backrest during the erecting movement of the seating surface, that is, upon changeover from one limit position to the other.

In operation, practically no relative movement between the body of the user and the seat 27 or the backrest 37 will result upon changeover of the structure from either limiting position to the other due to the location of the pivot points 86, 41' between the seat 27 and the foot supports 75, 76 on the one hand and between the seat 27 and the backrest 37 on the other. As shown, the pivot point of the seat 27 is located behind the front edge of the seat and below the seating surface, so that the actual pivoting movement of the seat with respect to the frame 1, or, rather, with respect to the lateral frame members **1*a*, 1*b* is placed to be anatomically correct with respect to the position of the joints of the average user. The back 37, however, is connected to the seat 27** by pivot points which are located some distance above the seating surface, again in order to match approximately the increased height of the hip joint of a user with respect to the knees of the user when in seated position. Various other changes and modifications may be made within the scope of the inventive concept.

I claim:

1. Erecting wheel chair to assist users, particularly invalids, from seated to upright, standing position comprising a frame (1) including laterally spaced frame members **(1*a*, 1*b*)**;

a seat (27) having a seating surface;

pivot means (6, 7) defining a seat pivot axis connecting the frame and the seat and permitting pivoting of the seat from an essentially horizontal end position to an essentially vertical end position;

a seat erecting mechanism to move the seat between horizontal and vertical, erected position having motor means (9, 10) having an essentially uniform output speed, a drive shaft (12) extending between the spaced frame members and driven from the motor means (9, 10), and two crank drives (11, 23; 13, 24), respectively coupled to the drive shaft (12) at adjacent ends thereof and connected to the seat (27) to pivot the seat about its seat pivot means, and positioned to provide, with essentially uniform speed of the drive shaft (12), an erecting or lowering movement of the seat which is non-linear and has a time-displacement function which is essentially sinusoidal to start movement of the seat from one end position slowly then accelerate movement of the seat and, as the seat reaches its other end position to again move the seat slowly and thereby provide gradual smooth transition of the seat from stopped state at the end positions with an intermediate movement a speed which is high with respect to the speed of the seat when adjacent the limiting, end position;

a back rest (37);

means (41, 41') coupling the seat to the backrest to move conjointly with said temporally non-linear movement of the seat including parallelogram link means (8, 41, 42) and a backrest pivot (41') maintaining the backrest (37) in essentially vertical position at all intermediate locations between the end limiting positions of the seat, the backrest pivot means (41'), being located above the level of the seat by a distance corresponding approximately to the height of the hip joint above the seating surface of the body of the user, so that, upon change of the seat from seating position to erected position, substantial relative movement between the body of the user and the seat as well as the backrest are avoided, and a footrest (75, 76) linked to the seat (27), the link between the footrest and the seat including a footrest pivot (86) located below the level of the seat and arranged to prevent substantial relative movement between the body of the user and the footrest during said temporally non-linear movement of the seat upon change of the position of the seat between seated and standing, upright position, said footrest including a link element (77, 78) linking the footrest pivot (86) to the frame, said link element being connected to the frame (1) behind the front edge of the seat and below the seating surface and being pivoted to the frame (1), and floor support means (79, 80) movably linked to the seat to move upwardly when the seat is in a horizontal, seating position and to move downwardly when the seat is its end limit erected position to provide a solid ground support when the chair is erected.

2. Wheel chair according to claim 1 further comprising at least one spring (28, 29) linked between the frame (1) and the seat (27) and located with respect to the seat to effect a torque which is approximately proportional, and in a direction counter the torque resulting from the application of the weight of the user on the seat.

3. Wheel chair according to claim 2 comprising at least one spring (28, 29) located at either side of the laterally spaced frame members **(1*a*, 1*b*)**.

4. Wheel chair according to claim 3 wherein a plurality of springs are located at either side of the laterally spaced frame members, each one of the springs of the plurality being essentially similar to any other spring.

5. Erecting wheelchair according to claim 1 wherein the laterally spaced frame members (1*a*, 1*b*) are essentially similar and parallel to each other;

and wherein the wheelchair further comprises collapsible strut elements (12, 53, 63, 54) spacing the laterally spaced frame members (1*a*, 1*b*), respectively, as selectively desired at a first wider distance (D) from each other when to be used by a patient, and permitting collapse of the laterally spaced frame members towards each other to result in a narrow spacing (d), and means, selectively maintaining the struts at said first wider distance (D), and an articulated joint (50) located intermediate the length of the drive shaft (12) and permitting folding of the drive shaft, the drive shaft forming one of the strut elements when in unfolded, in-line position.

6. Wheelchair according to claim 5 further comprising a connecting rod (52) connecting the joint (52) on the drive shaft (53) to others of said strut elements (53, 63, 54) to provide for conjoint collapse of said other strut elements and the drive shaft (12).

7. Wheelchair according to claim 6 wherein the connecting rod (52) forms a connecting link;

and others of said strut elements (64, 65) form a scissor linkage coupled to the frame members (1*a*, 1*b*) to insure conjoint operation of the folding of said frame members.

8. Wheelchair according to claim 1 further comprising footrest panels (81, 82) and a footrest frame removably attached to the seat.

9. Wheelchair according to claim 1 further comprising footrest panels (81, 82) which are height adjustable with respect to the seat.

10. Wheelchair according to claim 1 further comprising a footrest frame (75, 76);

footrest panels (81, 82);

guide means connecting the footrest frame and the footrest panels (81, 82) guiding the footrest panels along the footrest frame;

and clamping means (84, 85) clamping the guide means to the footrest frame.

11. Wheelchair according to claim 1 further comprising two footrest panels, one each positioned at either side of the seat (27), the panels extending toward each other;

and lockable pivot means (83) connecting said panels to permit locking the panels in aligned position or, selectively, folding the panels towards each other and thereby permit folding of the wheelchair.

12. Wheelchair according to claim 1 wherein the parallelogram link means comprises parallelogram rods (41, 42) pivoted to the backrest (37), a seat frame member (8), and pivot means connecting the parallelogram rods and the seat frame member to the backrest, the parallelogram rods being located below the seat frame member to place the seating surface of the seat above the parallelogram rods.

13. Wheelchair according to claim 5 further comprising at least one spring (28, 29) linked between the frame (1) and the seat (27) and located with respect to the seat to effect a torque which is approximately proportional, and in a direction counter the torque resulting from the application of the weight of the user on the seat.

14. Wheelchair according to claim 12 wherein the laterally spaced frame members (1*a*, 1*b*) are essentially similar and parallel to each other;

and wherein the wheelchair further comprises collapsible strut elements (12, 53, 63, 54) spacing the laterally spaced frame members (1*a*, 1*b*), respectively, as selectively desired at a first wider distance (D) from each other when to be used by a patient, and permitting collapse of the laterally spaced frame members towards each other to result in a narrow spacing (d), and means, selectively, maintaining the struts at said first wider distance (D), and an articulated joint (50) located intermediate the length of the drive shaft (12) and permitting folding of the drive shaft, the drive shaft forming one of the strut elements when in unfolded, in-line position.

15. Wheelchair according to claim 14, further comprising a connecting rod (52) connecting the joint (52) on the drive shaft (53) to others of said strut elements (53, 63, 54) to provide for conjoint collapse of said other strut elements and the drive shaft (12).

16. Erecting wheel chair to assist users, particularly, invalids, from seated to upright, standing position comprising a frame (1) including laterally spaced frame members (1*a*, 1*b*);

a seat (27) having a seating surface;

pivot means (6, 7) defining a seat pivot axis connecting the frame and the seat and permitting pivoting of the seat from an essentially horizontal end position to an essentially vertical end position;

a backrest (37);

and a seat erecting mechanism to move the seat between horizontal and vertical, erected position, motor means (9, 10) having an essentially uniform output speed;

a drive shaft (12) extending between the spaced frame members and driven from the motor means (9, 10);

two crank drives (11, 23; 13, 24), respectively coupled to the drive shaft (12) at adjacent ends thereof and connected to the seat (27) to pivot the seat about its seat pivot means, and positioned to provide, with essentially uniform speed of the drive shaft (12), an erecting or lowering movement of the seat which is non-linear and has a time-placement function which is essentially sinusoidal to start movement of the seat from one end position slowly then accelerate movement of the seat and, as the seat reaches its other end position to again move the seat slowly and thereby provide gradual smooth transition of the seat from stop state at the end positions with an intermediate movement a speed which is high with respect to the speed of the seat when adjacent the limiting, end position;

and means (41, 41') coupling the seat to the backrest to move conjointly with temporally non-linear movement of the seat;

and wherein the laterally spaced frame members (1*a*, 1*b*) are essentially similar and parallel to each other;

and wherein the wheelchair further comprises collapsible strut elements (12, 53, 63, 54) spacing the laterally spaced frame members (1*a*, 1*b*) respectively, as selectively desired at a first wider distance (D) from each other when to be used by a patient, and permitting collapse of the laterally spaced frame members towards each other to result in a narrow spacing (d), and means, selectively maintaining the struts at said first wider distance (D) and an articulated joint (50) located intermediate the length of the drive shaft (12) and permitting folding of the drive shaft, the drive shaft forming one of the strut elements when in unfolded, in-line position.

17. Wheelchair according to claim 16 further comprising a connecting rod (52) connecting the joint (52) on the drive shaft (53) to others of said strut elements (53, 63, 54) to provide for conjoint collapse of said other strut elements and the drive shaft.

* * * * *